US008127539B2

(12) United States Patent
Kato et al.

(10) Patent No.: US 8,127,539 B2
(45) Date of Patent: Mar. 6, 2012

(54) EXHAUST MANIFOLD

(75) Inventors: Seiji Kato, Saitama (JP); Kunikazu Ban, Saitama (JP); Akira Kawamura, Saitama (JP)

(73) Assignee: Calsonic Kansei Corporation, Saitama-shi (JP)

( * ) Notice: Subject to any disclaimer, the term of this patent is extended or adjusted under 35 U.S.C. 154(b) by 667 days.

(21) Appl. No.: 12/307,979

(22) PCT Filed: Jun. 26, 2007

(86) PCT No.: PCT/JP2007/062766

§ 371 (c)(1),
(2), (4) Date: Jan. 8, 2009

(87) PCT Pub. No.: WO2008/007537

PCT Pub. Date: Jan. 17, 2008

(65) Prior Publication Data

US 2009/0199551 A1 Aug. 13, 2009

(30) Foreign Application Priority Data

Jul. 10, 2006 (JP) ..... 2006-189737
Aug. 9, 2006 (JP) ..... 2006-217389

(51) Int. Cl.
*F01N 1/00* (2006.01)
*B23P 15/26* (2006.01)
*B23P 17/00* (2006.01)

(52) U.S. Cl. ..... 60/323; 29/890.052; 29/890.08

(58) Field of Classification Search ..... 60/302, 60/323, 324; 29/890.052, 890.08
See application file for complete search history.

(56) References Cited

U.S. PATENT DOCUMENTS

| | | | | |
|---|---|---|---|---|
| 4,373,329 | A * | 2/1983 | Martini | 60/305 |
| 5,727,386 | A * | 3/1998 | Watanabe et al. | 60/323 |
| 6,837,044 | B2 * | 1/2005 | Kobayashi et al. | 60/323 |
| 2007/0039319 | A1 * | 2/2007 | Kajita | 60/323 |

FOREIGN PATENT DOCUMENTS

| | | | |
|---|---|---|---|
| JP | 63-174527 | U | 11/1988 |
| JP | 2003-083062 | A | 3/2003 |
| JP | 2003-269159 | A | 9/2003 |
| JP | 2005-307920 | A | 11/2005 |
| JP | 2006-242079 | A | 9/2006 |

* cited by examiner

*Primary Examiner* — Thomas Denion
*Assistant Examiner* — Audrey K Bradley
(74) *Attorney, Agent, or Firm* — Foley & Lardner LLP

(57) ABSTRACT

An exhaust manifold includes a plurality of branch pipes 2 to 5 and an adapter member 9 that has a ring portion 10 provided at exhaust-gas downstream side end portions 2*a* to 5*a* of the branch pipes 2 to 5 and with a reinforcement portion 11. The adapter member 9 and the exhaust-gas downstream side end portions 2*a* to 5*a*, which are inserted into the adapter member 9, are fixed with each other by a circular weld line X1 formed along outer circumferences of the exhaust-gas downstream side end portions 2*a* to 5*a* of the branch pipes 2 to 5 and also by a weld line X2 formed along the adjacent side wall portions 2*b* to 5*b* of the branch pipes 2 to 5.

6 Claims, 9 Drawing Sheets

PRIOR ART

EXHAUST MANIFOLD

TECHNICAL FIELD

The present invention relates to an exhaust manifold that constitutes a part of an exhaust system for discharging exhaust gas outputted from an engine mounted on a motor vehicle.

BACKGROUND OF THE INVENTION

Such conventional exhaust manifolds are disclosed in Japanese Patent applications Publication No. 2003-83062, No. 2005-307920 and No. 2003-83062, and they include a plurality of branch pipes that are connected with a head flange of an engine, and a collecting part that collects downstream side end portions of the branch pipes to be connected with a catalytic converter.

Further, in these conventional exhaust manifolds, as shown in FIG. 11, a reinforcement member 09, which is formed like a cross shape, is inserted in a space formed among downstream side end portions 02*a* to 05*a* of branch pipes 02 to 05, and they are fixed with one another by welding.

DISCLOSURE OF THE INVENTION

Problem(s) to be Solved by the Invention

The conventional exhaust manifolds, however, have the following problems. When the reinforcement member and the branch pipes are welded, a jig is needed in order to temporally assemble them in a state where they are properly positioned. In addition, in this welding process, heat stress due to the welding concentrates on a certain portion thereof.

The present invention is made to solve the above-described problems, and its object is to provide an exhaust manifold in which a plurality of branch pipes and a reinforcement member can be easily welded in the state where they are temporally assembled with high accuracy and the heat stress can disperse in this welding process.

Means for Solving the Problems

According to a first aspect of the present invention there is provided an exhaust manifold including a plurality of branch pipes that are connected with a head flange, an adapter member, and a collecting part that is connected with exhaust-gas downstream side end portions of the branch pipes through the adapter member. The adapter member has a ring portion and a reinforcement portion that is formed like a pillar with the ring portion as one unit, the pillar being formed along from an exhaust-gas upstream side end surface of the ring portion to an exhaust-gas downstream side end surface of the ring portion and toward a center of the ring portion from the ring portion. The exhaust-gas downstream side end portions of the branch pipes are inserted into insertion holes formed between the ring portion and the reinforcement portion of the adapter member so that exhaust-gas downstream side end surfaces of the branch pipes are located on the same plane as the exhaust-gas downstream side end surface of the adapter member. The adapter member and the exhaust-gas downstream side end portions of the branch pipes are fixed with each other by a circular weld line formed along outer circumferences of the exhaust-gas downstream side end portions of the branch pipes at the exhaust-gas downstream side end surface of the adapter member and a weld line formed along adjacent side wall portions of the branch pipes.

According to a second aspect of the present invention there is provided an exhaust manifold including four branch pipes that are connected with a head flange, an adapter, and a collecting part that is connected with exhaust-gas downstream side end portions of the branch pipes through the adapter member. The adapter member has a ring portion and a reinforcement portion that is formed like a cross shaped pillar with the ring portion as one unit, the cross shaped pillar being formed along from an exhaust-gas upstream side end surface of the ring portion to an exhaust-gas downstream side end surface of the ring portion and toward a center of the ring portion from the ring portion. The exhaust-gas downstream side end portions of the branch pipes are inserted into insertion holes that have a quarter circle shape and formed between the ring portion and the reinforcement portion of the adapter member so that exhaust-gas downstream side end surfaces of the branch pipes are located on the same plane as the exhaust-gas downstream side end surface of the adapter member. The adapter member and the exhaust-gas downstream side end portions of the branch pipes are fixed with each other by a circular weld line formed along outer circumferences of the exhaust-gas downstream side end portions of the branch pipes at the exhaust-gas downstream side end surface of the adapter member and weld line formed like a cross shape along adjacent side wall portions of the branch pipes.

Effect of the Invention

The exhaust manifold of the first invention includes the plurality of branch pipes that are connected with the head flange, the adapter member, and the collecting part that is connected with the exhaust-gas downstream side end portions of the branch pipes through the adapter member. The adapter member has the ring portion and the reinforcement portion that is formed like the pillar with the ring portion as one unit, the pillar being formed along from the exhaust-gas upstream side end surface of the ring portion to the exhaust-gas downstream side end surface of the ring portion and toward the center of the ring portion from the ring portion. The exhaust-gas downstream side end portions of the branch pipes are inserted into insertion holes formed between the ring portion and the reinforcement portion of the adapter member so that exhaust-gas downstream side end surfaces of the branch pipes are located on the same plane as the exhaust-gas downstream side end surface of the adapter member. The adapter member and the exhaust-gas downstream side end portions of the branch pipes are fixed with each other by the circular weld line formed along outer circumferences of the exhaust-gas downstream side end portions of the branch pipes at the exhaust-gas downstream side end surface of the adapter member and the weld line formed along adjacent side wall portions of the branch pipes. Therefore, the branch pipes can be easily welded in the state where they are properly positioned. In addition, the heat stress generated in the welding process can disperse over the entire portions of the ring portion.

The exhaust manifold of the second invention includes the four branch pipes that are connected with the head flange, the adapter, and the collecting part that is connected with the exhaust-gas downstream side end portions of the branch pipes through the adapter member. The adapter member has the ring portion and the reinforcement portion that is formed like the cross shaped pillar with the ring portion as one unit, the cross shaped pillar being formed along from the exhaust-gas upstream side end surface of the ring portion to the exhaust-gas downstream side end surface of the ring portion and toward the center of the ring portion from the ring portion.

The exhaust-gas downstream side end portions of the branch pipes are inserted into insertion holes that have one quarter circle shape and formed between the ring portion and the reinforcement portion of the adapter member so that exhaust-gas downstream side end surfaces of the branch pipes are located on the same plane as the exhaust-gas downstream side end surface of the adapter member. The adapter member and the exhaust-gas downstream side end portions of the branch pipes are fixed with each other by the circular weld line formed along outer circumferences of the exhaust-gas downstream side end portions of the branch pipes at the exhaust-gas downstream side end surface of the adapter member and the weld line formed like the cross shape along adjacent side wall portions of the branch pipes. Therefore, the four branch pipes can be easily welded in the state where they are properly positioned, although it is difficult to properly position the four branches of the conventional exhaust manifold. In addition, the heat stress generated in the welding process can disperse over the entire portions of the ring portion 10 in a balanced manner.

BRIEF DESCRIPTION OF THE DRAWINGS

The objects, features and advantages of the present invention will become apparent as the description proceeds when taken in conjunction with the accompanying drawings, in which.

DESCRIPTION OF REFERENCE NUMBERS

Figure 1:
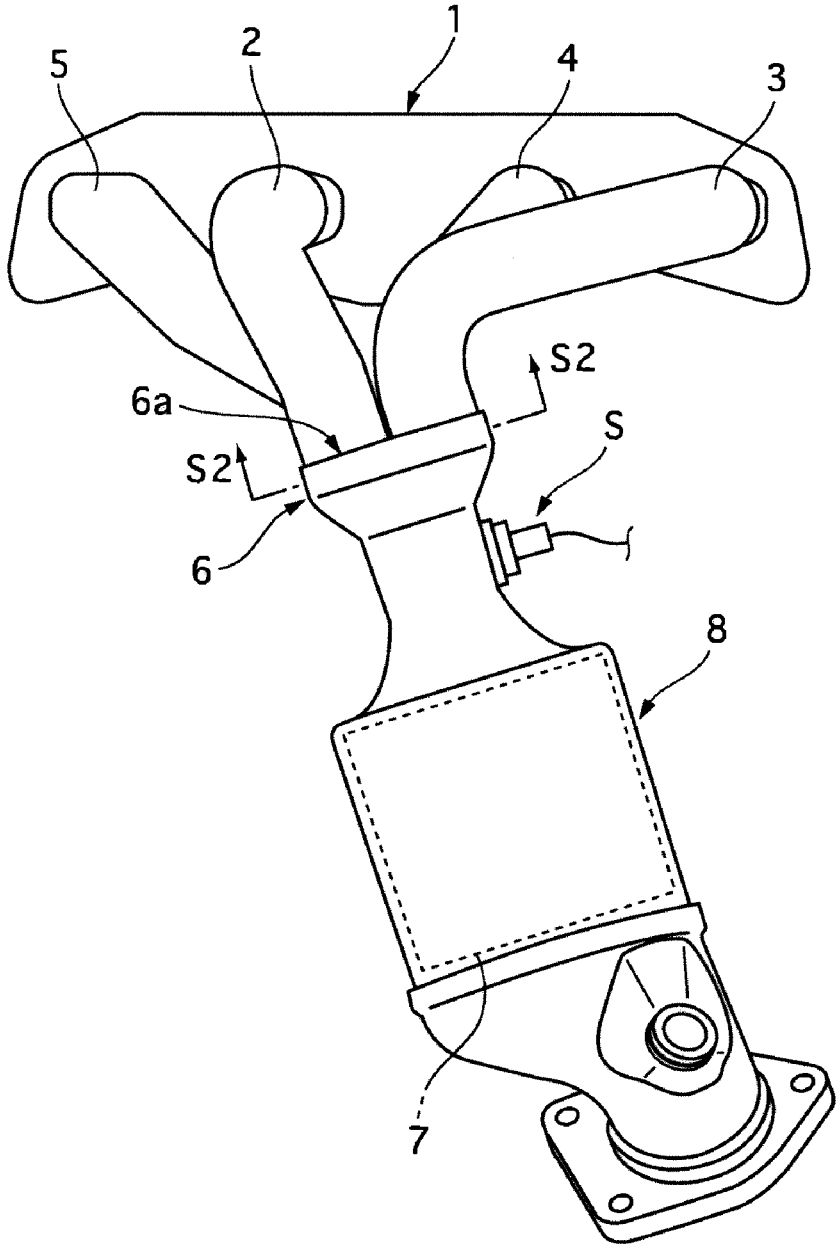
FIG. 1 is a plain view showing an entire structure of an exhaust manifold of a first embodiment according to the present invention.

S oxygen sensor
X1, X2 weld line
1 head flange
2, 3, 4, 5 branch pipe
2*a*, 3*a*, 4*a*, 5*a* exhaust-gas downstream side end portion (of the branch pipe)
2*b*, 3*b*, 4*b*, 5*b* adjacent side wall portions (of the branch pipe)
6 collecting part
6*a* exhaust-gas upstream side end portion (of the collecting part)
7 catalyst substrate
8 catalytic converter
9 adapter member
9*a* exhaust-gas downstream side end surface (of the adapter member)
9*b* outer circumferential portion (of the adapter member)
10 ring portion
10*a* exhaust-gas upstream side end surface (of the ring portion)
10*b* exhaust-gas downstream side end surface (of the ring portion)
11 reinforcement portion
12*a*, 12, 12*c*, 12*d* insertion hole
20 adapter member
21 metal sheet material
22 preformed member to be adapter member

BEST MODE FOR CARRYING OUT THE INVENTION

Throughout the following detailed description, similar reference characters and numbers refer to similar elements in all figures of the drawings, and their descriptions are omitted for eliminating duplication.

Hereinafter, a first embodiment of the present invention will be described with reference to the accompanying drawings.

First Embodiment

The first embodiment will be described.

Figure 2:
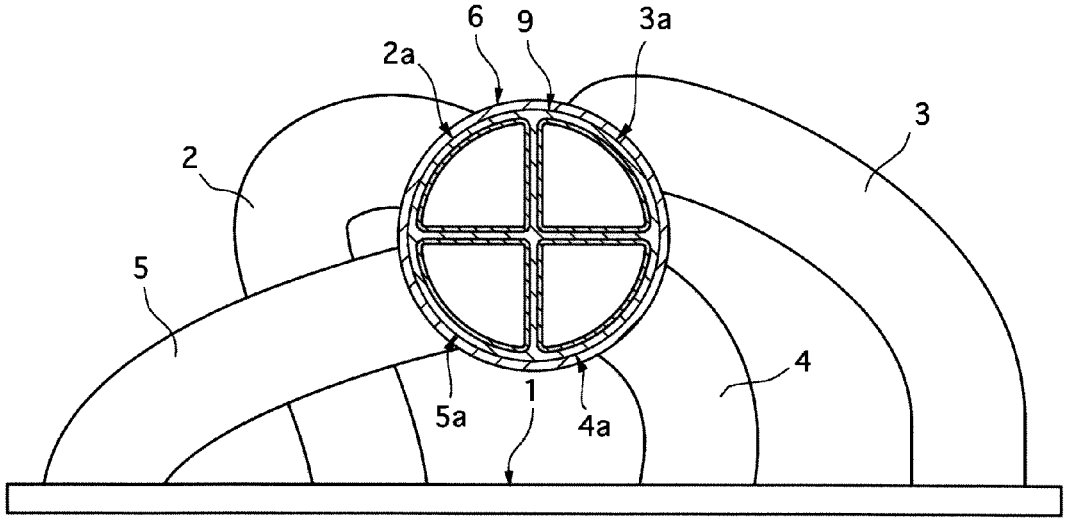
FIG. 2 is a cross sectional view of the exhaust manifold taken along a line S2-S2 in FIG. 1.
Figure 3:
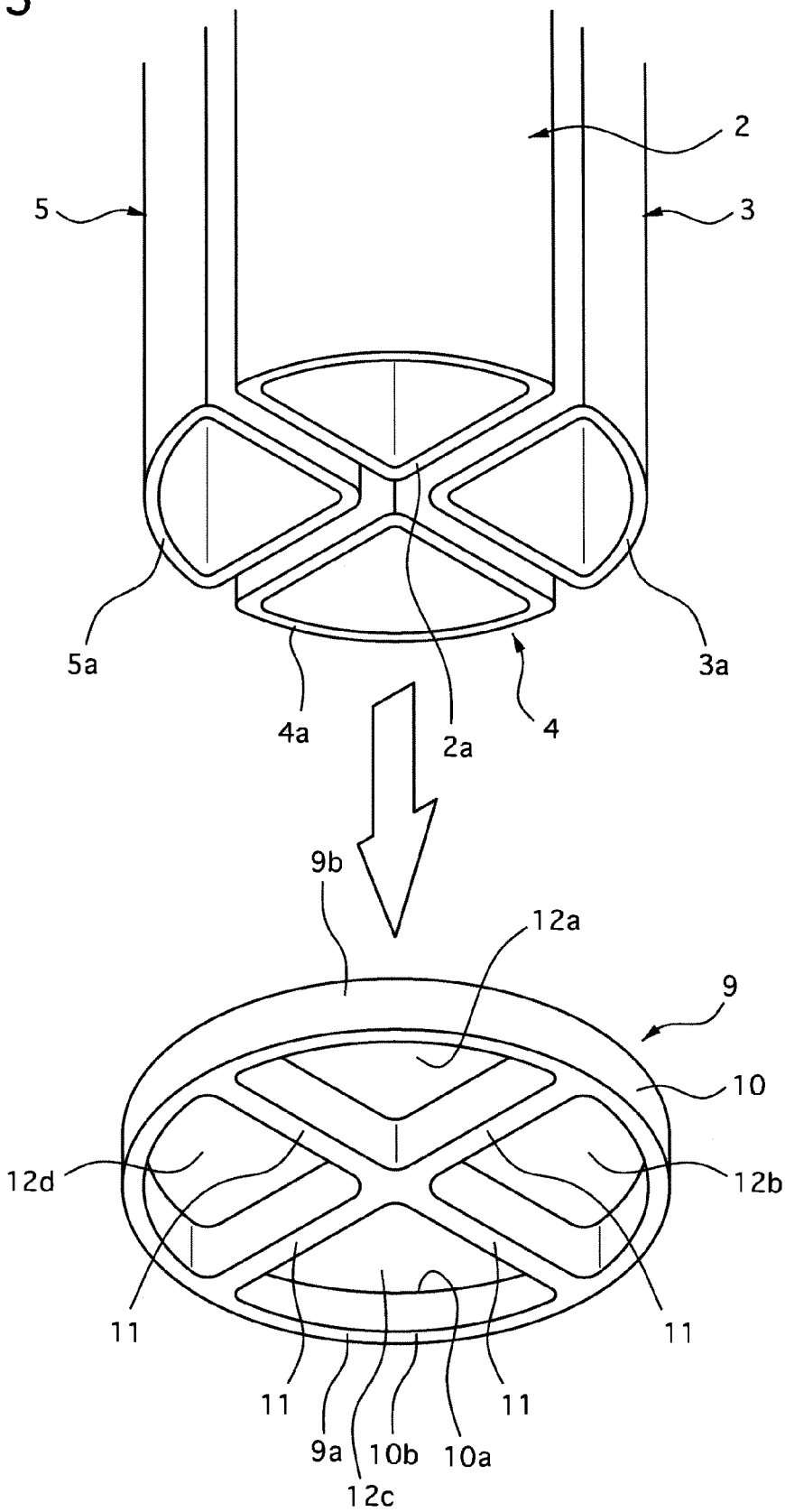
FIG. 3 is a perspective view showing exhaust-gas downstream side end portions of branch pipes and an adapter member used in the first embodiment.
Figure 4:
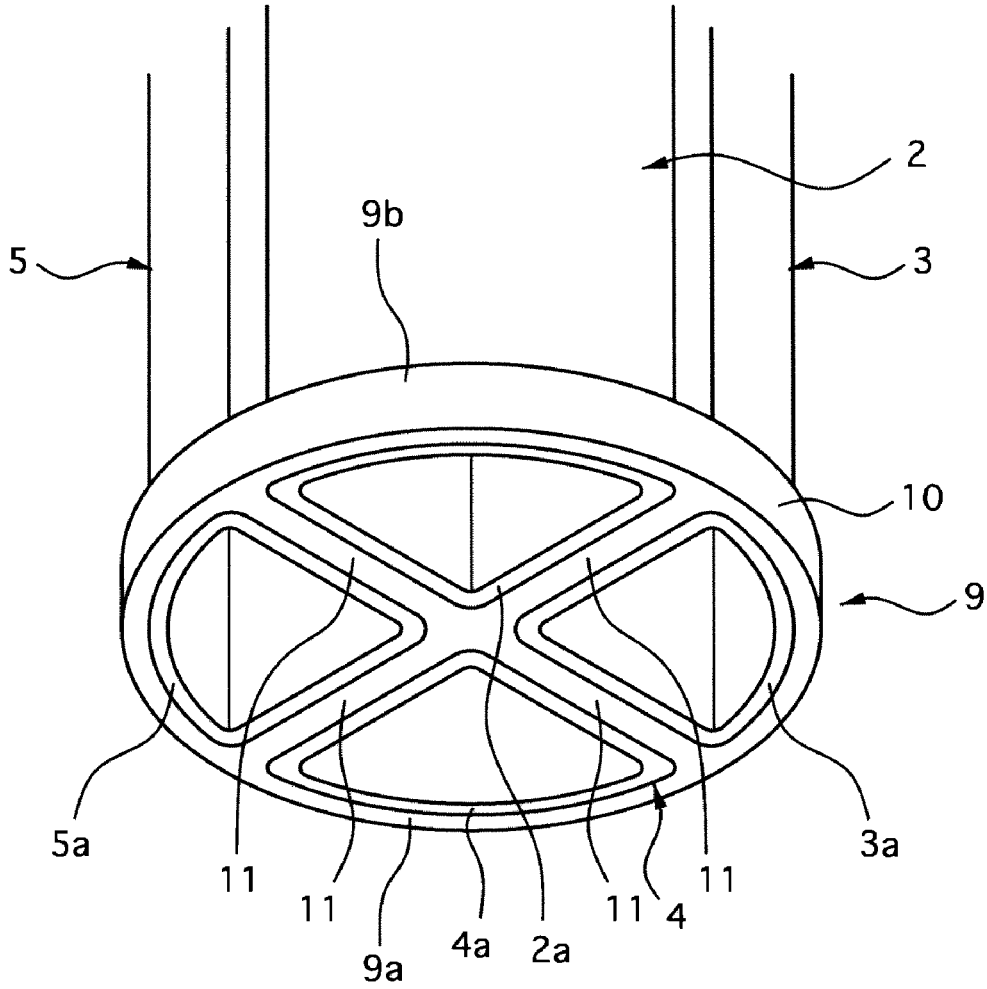
FIG. 4 is a view illustrating a positioning of the branch pipes and the adapter member of the first embodiment.

FIG. 1 is a plain view showing an entire structure of an exhaust manifold of the first embodiment according to the present invention, FIG. 2 is a cross sectional view showing the exhaust embodiment taken along a line S2-S2 in FIG. 1, FIG. 3 is a perspective view showing exhaust-gas downstream side end portions of branch pipes and an adapter member of the first embodiment, and FIG. 4 is a view illustrating a positioning of the branch pipes and the adapter member of the first embodiment.

Figure 5:
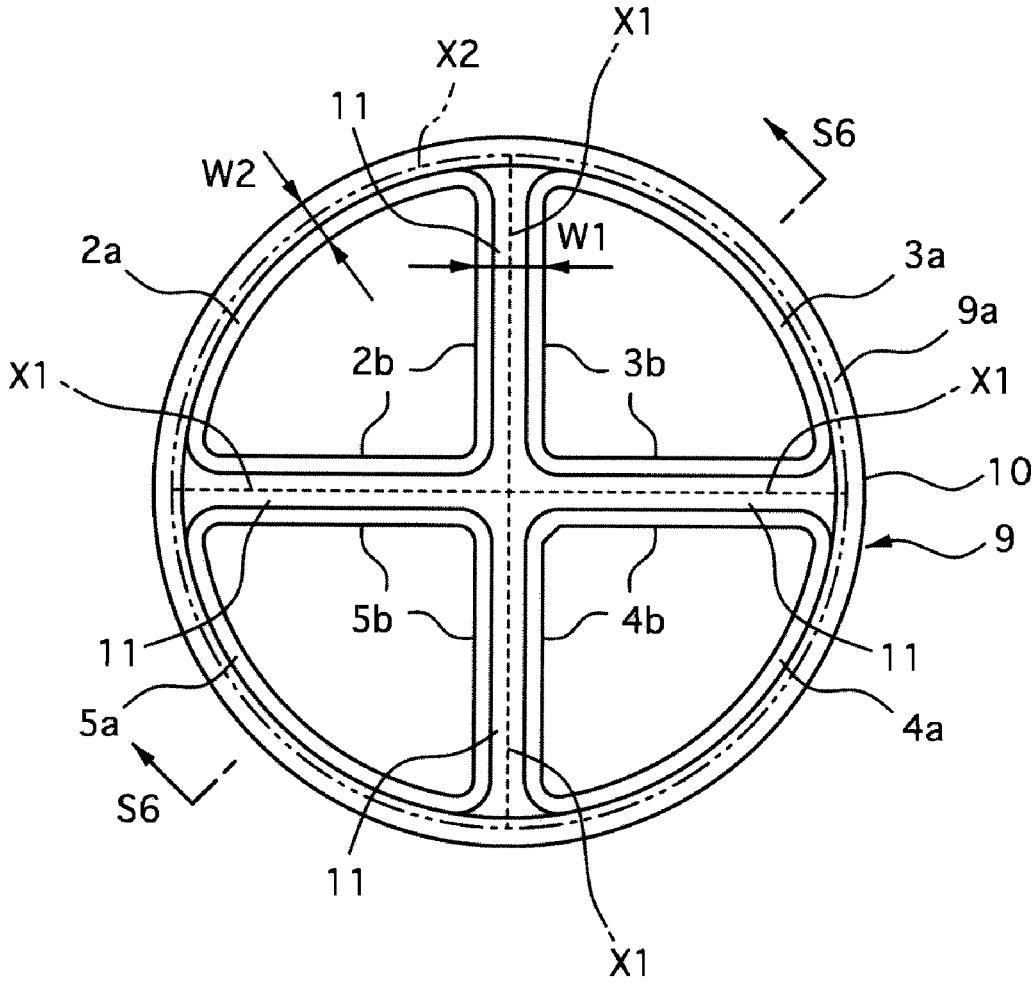
FIG. 5 is a view illustrating a fixation by welding (The welded lines X1 and X2 are simply shown) the branch pipes and the adapter member of the first embodiment with each other.
Figure 6:
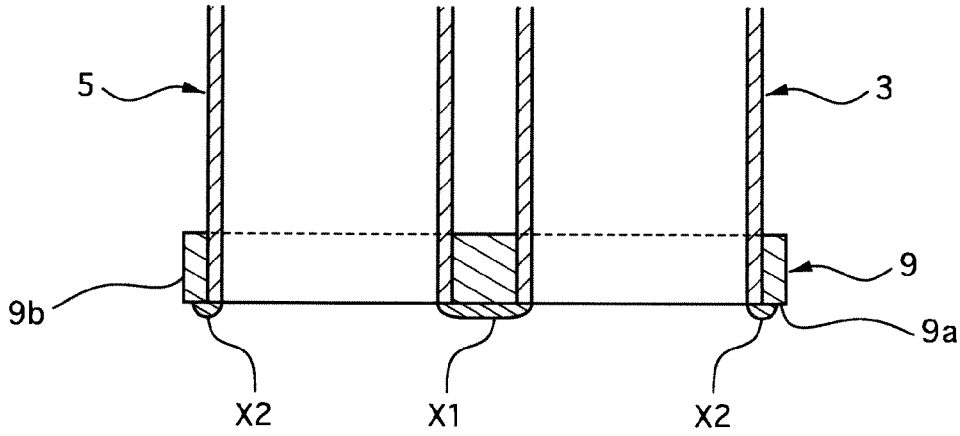
FIG. 6 is a cross sectional view of the exhaust-gas downstream side end portions of branch pipes taken along a line S6-S6 in FIG. 5.
Figure 7:
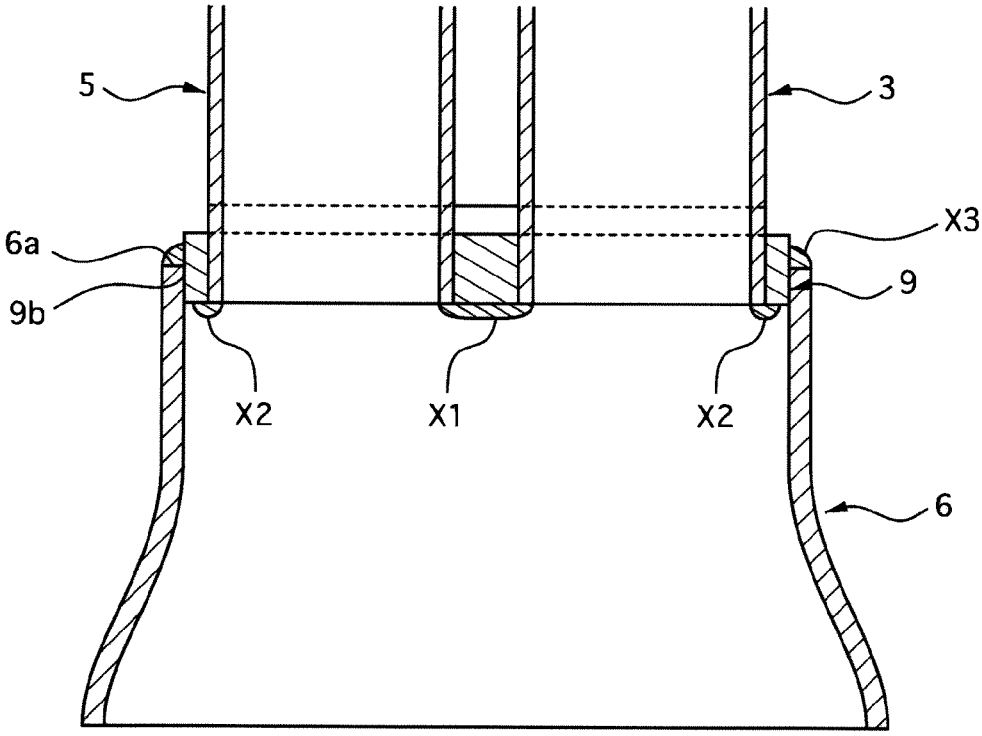
FIG. 7 is a view illustrating a fixation of the branch pipes, the adapter member and a collecting part of the first embodiment.

FIG. 5 is a view illustrating a fixation by welding (The weld lines X1 and X2 are simply shown) the branch pipes and the adapter member of the exhaust pipe of the first embodiment with each other, FIG. 6 is a cross sectional view of the downstream side end portions and the adapter member taken along a line S6-S6 in FIG. 5, and FIG. 7 is a view illustrating a fixation of the branch pipes, the adapter member and a collecting part of the first embodiment.

First, an entire construction of the exhaust manifold of the first embodiment will be described.

As shown in FIG. 1, the exhaust manifold of the first embodiment mainly includes a head flange 1 that is fixed on a not-shown engine, four branch pipes 2 to 5 that are connected with the engine through the head flange 1, a collecting part 6 that is formed like a circular cylinder, and a catalytic converter 8 that is connected with the collecting part 6 and contains catalyst substrate.

Further, exhaust-gas downstream side end portions 2*a* to 5*a* of the branch pipes 2 to 5 are connected with the collecting part 6 through the adapter member 9, which will be later explained, in a state where they are inserted into the collecting part 6.

Specifically, as shown in FIG. 3, the exhaust-gas downstream side end portions 2*a* to 5*a* of the branch pipes 2 to 5 are formed to have a cross section of substantially one quarter circular shape, and they are also formed to be flat along an axial direction thereof.

On the other hand, the adapter member 9 has a ring portion 10 formed like an annulus and a reinforcement portion 11 having a substantially cross shaped pillar that is formed with the ring portion 10 as one unit so that the pillar is formed along from an exhaust-gas upstream side end surface 10*a* of the ring portion 10 to an exhaust-gas downstream side end surface 10*b* thereof and toward an center of the ring portion 10 from an inner surface of the ring portion 10. Incidentally, the dimensions of portions of the adapter member 9 may be set appropriately.

In addition, in order to obtain the adapter member 9 of the first embodiment, a metal material shaped like a long pillar is cut off to form four insertion holes 12*a* to 12*d*, which are shown in FIG. 3, where the insertion holes 12*a* to 12*d* are formed like the substantially one quarter circular shape between the ring portion 10 of the adapter member 9 and the reinforcement portion 11, and then the thus formed metal material is cut apart at certain intervals in its axial direction into a plurality of pieces having the same thickness of the adapter member 9 to be manufactured.

Incidentally, the insertion holes may be formed by using a forging method, an extrusion method or the like instead of a cutting method, and then the formed metal material is cut apart.

Accordingly, a lot of the adapter members 9 can be manufactured by a simple work.

On the other hand, as shown in FIG. 1, an oxygen sensor S is fixed on the collecting part 6 to detect an oxygen concentration of the exhaust gas passing through the collecting part 6 in order to feedback-control an air-fuel ratio to be supplied to the engine.

In addition, all of the above-described parts of the exhaust manifold are made of metal material. Incidentally, the catalyst substrate 7 of the catalytic converter 8 is not limited, and accordingly ceramic catalyst substrate may be adapted for example.

Next, the operation of the exhaust manifold of the first embodiment will be described.

In order to assemble the branch pipes 2 to 5, the adapter member 9 and the collecting part 6, first, the exhaust-gas downstream side end portions 2*a* to 5*a* of the branch pipes 2 to 5 are inserted, almost pressed, in the corresponding insertion holes 12*a* to 12*d* as shown in FIG. 3 and FIG. 4, in a state where they are aligned on a plane corresponding to the exhaust-gas downstream side end surface 9*a* of the adapter member 9.

In this insertion process, the branch pipes 2 to 5 and the adapter member 9 can be properly positioned relative to each other by adjusting the exhaust-gas downstream side end portions 2*a* to 5*a* of the branch pipes 2 to 5 and the exhaust-gas downstream side end surface 9*a* of the adapter member 9 to be on the same surface. Thus, a jig is not necessary for preventing a displacement therebetween.

Next, as shown in FIG. 5 and FIG. 6, the adapter member 9 and the exhaust-gas downstream side end portions 2*a* to 5*a* of the branch pipes 2 to 5 are fixed with each other as shown in FIG. 6. Specifically, the branch pipes 2 to 5 and the adapter member 9 are welded in a width a little smaller than a width W1 along outer circumferences of the exhaust-gas downstream side end portions 2*a* to 5*a* of the branch pipes 2 on the exhaust-gas downstream side end surface 9*a* of the adapter member 9, so that a circular weld line X1, which is indicated by a broken line, is formed. In addition, they are welded in the width a little smaller than the width W2 along the adjacent side wall portions 2*b* to 5*b* of each branch pipe 2 to 5, so that a substantially cross shaped weld line X2, which is indicated by a alternate long and two short dashes line, is formed. Incidentally, a process of forming the weld line X1 may be carried out after a process of forming the weld line X2.

In this process, since the exhaust-gas downstream side end portions 2*a* to 5*a* of the branch pipes 2 to 5 and the exhaust-gas downstream side end surface 9*a* of the adapter member 9 are aligned on the same surface as described above, the weld lines X1 and X2 can have nice welding property, thereby improving the high quality of the products.

In addition, the workability in the welding process can be improved, because it is not necessary to insert a torch of the welding in an interior of the ring portion 10.

In addition, in the welding process of the weld line X1, especially, the heat stress due to high temperature acts on a crossing portion of the reinforcement portion 11 in an outwardly radial direction, thereby root portions fixing the crossing portion and the ring portion 10 being easily cracked and/or broken. However, the reinforcement portion 11 can ensure its necessary rigidness, and the heat stress can disperse over the entire portions of the ring portion 10 in all possible directions in a balanced manner.

Next, as shown in FIG. 7, the adapter member 9 and the collecting part 6 are fixed with each other by the weld line X3, which is formed by welding along an exhaust-gas upstream side end portion 6*a* of the collecting part 6 and an entire outer circumferential portion 9*b* of the adapter member 9 in a state where the adapter member 9 is inserted into the exhaust-gas upstream side end portion 6*a* of the collecting part 6.

In this welding process, the exhaust-gas upstream side end portion 6*a* of the collecting part 6 and the outer circumferential portion 9*b* are welded with each other, and accordingly it can absorb length differences between the branch pipes 2 to 5. Therefore, an entire dimension relationship, including that of the collecting part 6, can be properly set.

Next, the effects of the first embodiment will be described.

As explained above, the exhaust manifold of the first embodiment includes the plurality of branch pipes 2 to 5 that are connected with the head flange 1, the adapter member 9, and the collecting part 6 that is connected with the exhaust-gas downstream side end portions 2*a* to 5*a* of the branch pipes 2 to 5 through the adapter member 9. The adapter member 9 has the ring portion 10 and the reinforcement portion 11 that is formed like the pillar with the ring portion 10 as one unit. The pillar is formed along from the exhaust-gas upstream side end surface 10*a* of the ring portion 10 to the exhaust-gas downstream side end surface 10*b* of the ring portion 10 and toward the center of the ring portion 10 from the ring portion 10. The exhaust-gas downstream side end portions 2*a* to 5*a* of the branch pipes 2 to 5 are inserted into insertion holes 12*a* to 12*d* formed between the ring portion 10 and the reinforcement portion 11 of the adapter member 9 so that exhaust-gas downstream side end surfaces 2*a* to 5*a* of the branch pipes 2 to 5 are located on the same plane as the exhaust-gas downstream side end surface 10*b* of the adapter member 9. The adapter member 9 and the exhaust-gas downstream side end portions 2*a* to 5*a* of the branch pipes 2 to 5 are fixed with each other by the circular weld line X1 that is formed along outer circumferences of the exhaust-gas downstream side end portions of the branch pipes 2 to 5 at the exhaust-gas downstream side end surface 10*a* of the adapter member 9 and the weld line X2 formed along adjacent side wall portions 2*b* to 5*b* of each branch pipe 2 to 5. Therefore, the branch pipes 2 to 5 can be easily welded in the state where they are properly positioned. In addition, the heat stress generated in the welding process can disperse over the entire portions of the ring portion 10, and the heat stress due to heat of the exhaust gas can disperse when the exhaust manifold is attached on the engine.

In addition, in the case where the inner circumferential surface of the adapter member 9 is welded with the branch pipes 2 to 5, the heat stress might concentrate on a stepped portion thereof. However, in the first embodiment, they are adjusted so that they are on the same surface, and therefore the heat stress can be prevented from concentrating.

Further, the adapter member 9 and the collecting part 6 are fixed with each other in such a way that the exhaust-gas upstream side end portions 6*a* of the collecting part 6 and the entire outer circumferential portion 9*b* of the adapter member 9 are welded along the weld line X3. Therefore, it can absorb the length difference among the branch pipes 2 to 5, thereby maintaining the entire dimension relationship, including the collecting part 6, to be proper.

In addition, the exhaust manifold of the first embodiment also includes the four branch pipes 2 to 5 that are connected with the head flange 1, the adapter 9, and the collecting part 6 that is connected with the exhaust-gas downstream side end portions 2*a* to 5*a* of the branch pipes 2 to 5 through the adapter member 9. The adapter member 9 has the ring portion 10 and the reinforcement portion 11 that is formed like the cross shaped pillar with the ring portion 10 as one unit. The cross shaped pillar is formed along from the exhaust-gas upstream side end surface 10*a* of the ring portion 10 to the exhaust-gas downstream side end surface 10*b* of the ring portion 10 and toward the center of the ring portion 10 from the ring portion 10. The exhaust-gas downstream side end portions 2*a* to 5*a* of the branch pipes 2 to 5 are inserted into insertion holes 12*a* to 12*d* that have one quarter circle shape and formed between the ring portion 10 and the reinforcement portion 11 of the adapter member 9 so that exhaust-gas downstream side end surfaces 2*a* to 5*a* of the branch pipes 2 to 5 are located on the same plane as the exhaust-gas downstream side end surface 10*b* of the adapter member 9. The adapter member 9 and the exhaust-gas downstream side end portions 2*a* to 5*a* of the branch pipes 2 to 5 are fixed with each other by the circular weld line X1 that is formed along outer circumferences of the exhaust-gas downstream side end portions 2*a* to 5*a* of the branch pipes 2 to 5 at the exhaust-gas downstream side end surface 10*b* of the adapter member 9 and the weld line X2 formed like the cross shape along adjacent side wall portions 2*b* to 5*b* of the branch pipes 2 to 5. Therefore, the four branch pipes 2 to 5 can be easily welded and fixed in the state where they are properly positioned, although the proper positioning by using a jig is very difficult in the conventional exhaust manifold. In addition, the heat stress, generated when the ring portion 10 is welded along the weld line X1, can disperse over the entire portions of the ring portion 10 in the all possible directions in the balanced manner.

Second Embodiment

Hereinafter, a second embodiment according to the present invention will be described.

Incidentally, the parts/portions of the second embodiment similar to those of the first embodiment are indicated by the same reference numbers, and their explanations are omitted, so that their differences will be described in detail.

Figure 8:
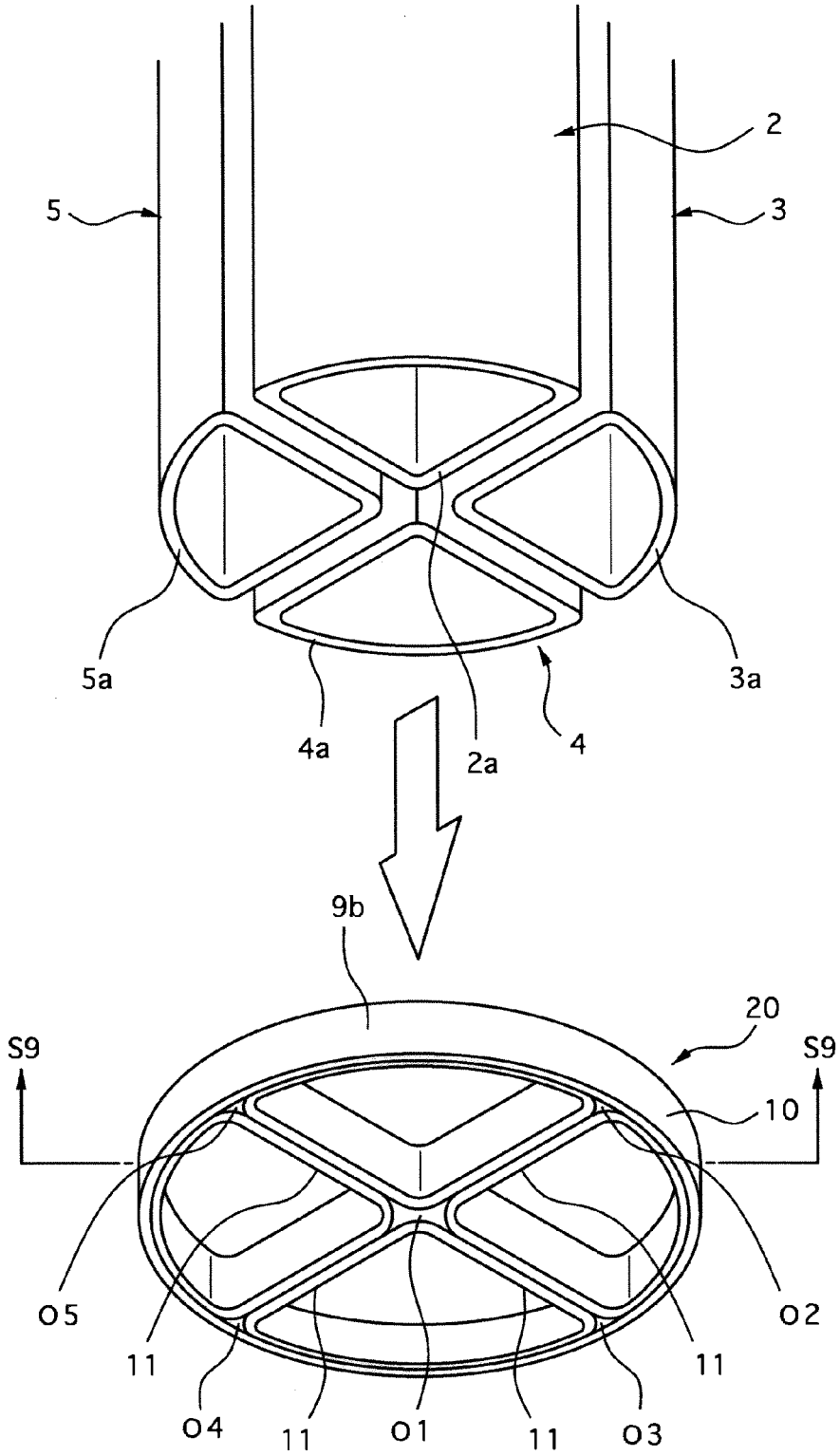
FIG. 8 is a perspective view showing a second embodiment in a state before branch pipes are inserted into an adapter member.
Figure 9:
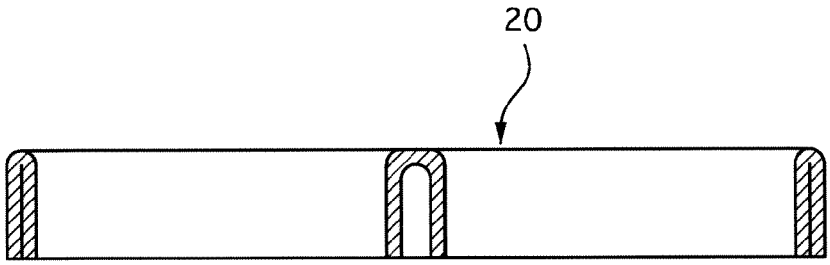
FIG. 9 is a cross sectional view of the adapter member taken along a line S9-S9 in FIG. 8.
Figure 10:
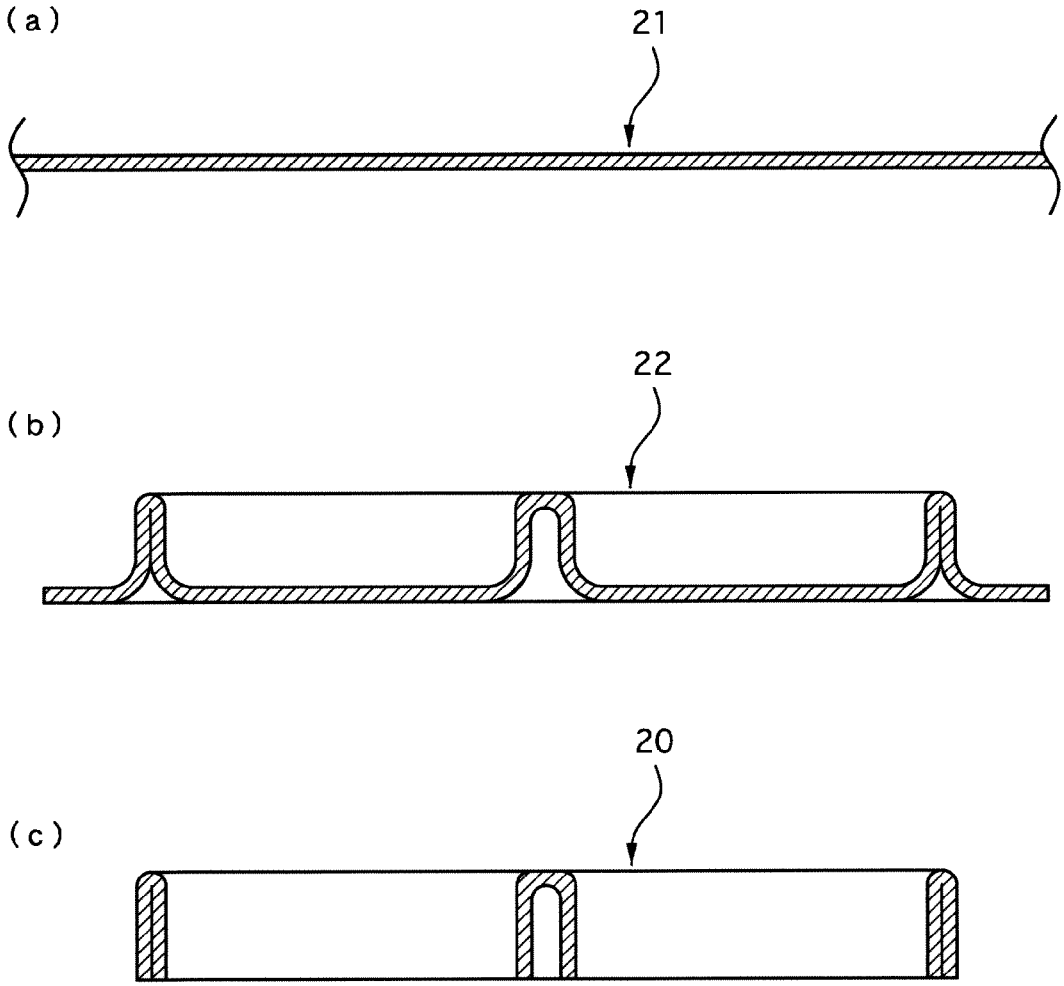
FIG. 10 is a view illustrating manufacturing processes of the adapter member of the second embodiment, FIG. 10(*a*) is a view showing a material of the adapter member, FIG. 10(*b*) is a view showing the adapter member in the middle of the manufacturing processes where side wall portions and bottom portions thereof are formed, FIG. 10(*c*) is a view showing the adapter member in the last forming process.
Figure 11:
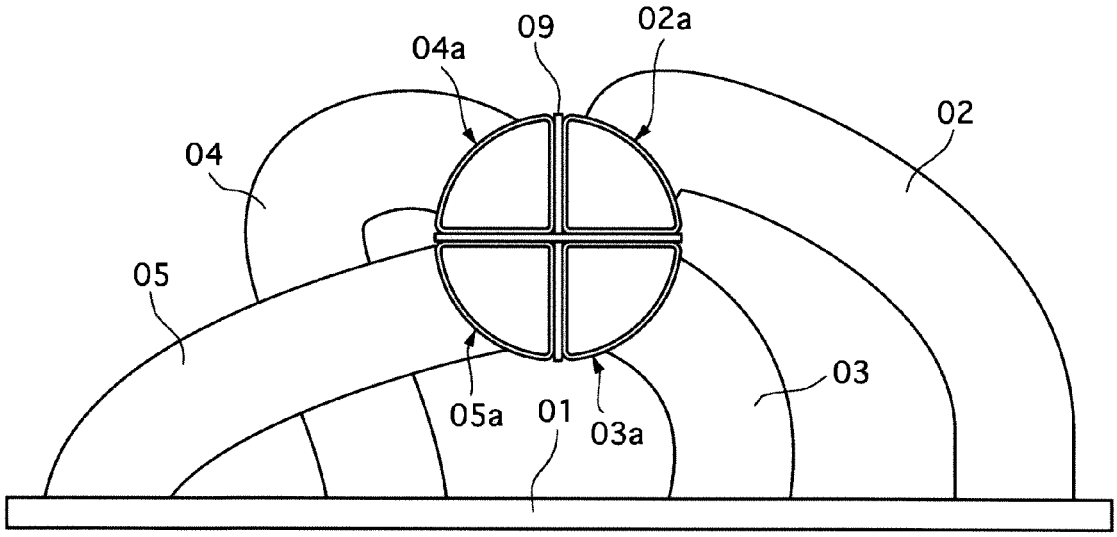
FIG. 11 is a view illustrating a fixation of branch pipes and a reinforcement member in a conventional exhaust manifold, where a collecting part thereof is omitted.

FIG. 8 is a perspective view showing branch pipes and an adapter member used in an exhaust manifold of the second embodiment according to the present invention, FIG. 9 is a cross sectional view showing the adapter member taken along a line S9-S9 in FIG. 8, and FIG. 10 is a view illustrating manufacturing process of the adapter member of the second embodiment.

The exhaust manifold of the second embodiment has an adapter member 20 that is different from the adapter member 9 of the first embodiment. That is, instead of the adapter member 9 of the first embodiment, the adapter member 20 of the second embodiment is manufactured as an integral part formed to have a back-folded structure by press working in such a way that a metal material is folded back according to the portions of the adapter member to be manufactured as shown in FIG. 8 and FIG. 9.

In a manufacturing process of the adapter member 20, a flat metal sheet 21 shown in FIG. 10(*a*) is prepared, and then a preformed member 22 is formed with side wall portions and bottom portions thereof through a plurality of press processes from the metal sheet 21. Then the bottom portions are punched out through a plurality of press processes to obtain the adapter member 20 having a desired configuration.

Accordingly, the adapter member 20 of the second embodiment can be manufactured earlier than that of the first embodiment. In addition, the dimensional accuracy of the parts/portions can be improved, and the assembly accuracy of the branch pipes 2 to 5 and the adapter member 20, including the weld lines X1 and X2, can be also improved.

Further, the necessary amount of the material can be decreased, thereby decreasing the manufacturing costs. The exhaust manifold can be reduced in weight, because apertures 01 to 05 are formed between the crossing portion consisting of the cross shaped portions of the reinforcement portion 11 and the fixing root portions of the reinforcement portion 11 and the ring portion 10 as shown in FIG. 8.

Further, the adapter member 20 is attached to the collecting at end portions (the aperture 01 to 05 side), shown in FIG. 8, of the portions that are folded back. This ensures the welding property to maintain better in the weld lines X1 and X2 of the branch pipes 2 to 5 and the adapter member 20 than that in a case where a top portion side of the back-folded portions of the adapter member 20 is headed toward the branch 2 to 5 side.

As explained above, in the exhaust manifold of the second embodiment, the adapter member 20 is formed as the integral press-formed part that has the back-folded structure in which the metal sheet 21 of the material is folded back in the axial direction according to the portions of the branch pipes 2 to 5, and accordingly it can save the weight and the material cost thereof, improving the yield ratio of the products, the manufacturing efficiency, and the dimensional accuracy of the parts/portions.

While there have been particularly shown and described with reference to preferred embodiments thereof, the present invention is not limited to the above-described embodiments, and its design changes and modifications are contained in the present invention as long as they do not deviate the scope of the present invention.

For example, the number of the branch pipes may be set appropriately according to the number of cylinders of an engine.

The invention claimed is:

1. An exhaust manifold comprising:

a plurality of branch pipes that are connected with a head flange;

an adapter member; and a collecting part that is connected with exhaust-gas downstream side end portions of the branch pipes through the adapter member, wherein the adapter member has a ring portion and a reinforcement portion that is formed like a pillar with the ring portion as one unit, the pillar being formed along from an exhaust-gas upstream side end surface of the ring portion to an exhaust-gas downstream side end surface of the ring portion and toward a center of the ring portion from the ring portion, wherein the exhaust-gas downstream side end portions of the branch pipes are inserted into insertion holes formed between the ring portion and the reinforcement portion of the adapter member so that exhaust-gas downstream side end surfaces of the branch pipes are located on the same plane as the exhaust-gas downstream side end surface of the adapter member; and wherein the adapter member and the exhaust-gas downstream side end portions of the branch pipes are fixed with each other by a circular weld line formed along outer circumferences of the exhaust-gas downstream side end portions of the branch pipes at the exhaust-gas downstream side end surface of the adapter member and a weld line formed along adjacent side wall portions of the branch pipes.

2. The exhaust manifold according to claim 1, wherein the adapter member is an integral press formed part that has a back-folded structure where a metal sheet is folded back according to the portions of the adapter member.

3. The exhaust manifold according to claim 1, comprising:

the adapter member and the collecting part are fixed with each other, in a state where the adapter member is inserted in an exhaust-gas upstream side end portion of the collecting part, by a weld line formed along outer circumferences of the exhaust-gas upstream side end portion of the collecting part and the adapter member.

4. The exhaust manifold according to claim 3, wherein the adapter member is an integral press formed part that has a back-folded structure where a metal sheet is folded back according to the portions of the adapter member.

5. An exhaust manifold comprising:

four branch pipes that are connected with a head flange;

an adapter; and a collecting part that is connected with exhaust-gas downstream side end portions of the branch pipes through the adapter member, wherein the adapter member has a ring portion and a reinforcement portion that is formed like a cross shaped pillar with the ring portion as one unit, the cross shaped pillar being formed along from an exhaust-gas upstream side end surface of the ring portion to an exhaust-gas downstream side end surface of the ring portion and toward a center of the ring portion from the ring portion, wherein the exhaust-gas downstream side end portions of the branch pipes are inserted into insertion holes that have a quarter circle shape and formed between the ring portion and the reinforcement portion of the adapter member so that exhaust-gas downstream side end surfaces of the branch pipes are located on the same plane as the exhaust-gas downstream side end surface of the adapter member; and wherein the adapter member and the exhaust-gas downstream side end portions of the branch pipes are fixed with each other by a circular weld line formed along outer circumferences of the exhaust-gas downstream side end portions of the branch pipes at the exhaust-gas downstream side end surface of the adapter member and weld line formed like a cross shape along adjacent side wall portions of the branch pipes.

6. The exhaust manifold according to claim 5, wherein the adapter member is an integral press formed part that has a back-folded structure where a metal sheet is folded back according to the portions of the adapter member.

* * * * *